United States Patent [19]

Sahi

[11] Patent Number: 4,925,685

[45] Date of Patent: May 15, 1990

[54] LID FOR FOOD TRAYS

[75] Inventor: Ash K. Sahi, Aurora, Canada

[73] Assignee: Du Pont Canada Inc., Mississauga, Canada

[21] Appl. No.: 164,475

[22] Filed: Mar. 4, 1988

[30] Foreign Application Priority Data

Mar. 11, 1987 [GB] United Kingdom ..... 8705712

[51] Int. Cl.[5] ..... B65D 85/00

[52] U.S. Cl. ..... 426/123; 426/396; 426/412

[58] Field of Search ..... 426/396, 412, 123; 53/432, 433, 434, 427

[56] References Cited

U.S. PATENT DOCUMENTS

| | | | |
|---|---|---|---|
| 3,230,093 | 1/1966 | Albertus | 426/123 |
| 3,481,101 | 12/1969 | Steadman | 53/433 |
| 3,695,900 | 10/1972 | Young et al. | 426/396 |
| 4,611,456 | 9/1986 | Gillio-tos et al. | 53/427 |

*Primary Examiner*—George Yeung

[57] ABSTRACT

The present invention provides a tray having a floor, walls attached thereto, said walls having a rim distal to the floor, said tray having food placed therein and an amorphous polyester, e.g. polyethylene terephthalate, a partially crystalline polyester, e.g. polyethylene terephthalate, or amorphous nylon film stretched across the rim and extending down the outer portion of the wall adjacent to the rim in a vacuum-induced thermally-set crimp. The polyester or nylon may optionally be blended with a compatibilized polyolefin.

22 Claims, 1 Drawing Sheet

LID FOR FOOD TRAYS

Figure 1:
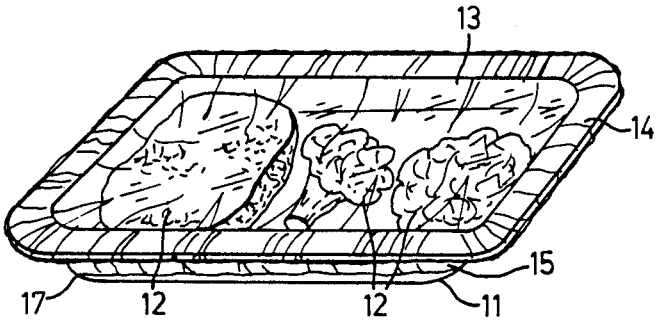

The present invention relates to a food package that is dual-ovenable.

It is known that food may be cooked in conventional ovens when placed on heat-resistant glass, enamelled metal or aluminium trays or pans. For retention of moisture in the food when cooking, a lid or aluminium foil over the tray or pan is desirable. It is known to prepackage food in aluminium trays with aluminium foil lids for cooking of foods in conventional convection ovens. Aluminium containers are unsuitable for cooking of foods in microwave ovens and, for prepackaged foods, glass containers are too heavy and expensive. Many plastics are excellent materials for microwave applications and it has become widespread to use thermoformed crystalline polyethylene terephthalate (CPET), both for the trays or pans and the lids. CPET may also be used for containers for cooking foods in conventional convection ovens. Thus, CPET is often viewed as being suitable for the manufacture of "dual-ovenable" containers, i.e. suitable for use in both conventional convection oven and microwave oven applications. Thermoformed lids tend to be expensive to manufacture, partly because of the thickness of sheet used to manufacture such lids and the quantity of waste formed in the thermoforming process.

Lids are an important component in food packages for the prepackaged food market, and have several functions. Rigid lids are useful for enabling food trays to be stacked, whether packaged in card boxes or not. If sealed to the tray, lids may be used to form, with the tray, a hermetically sealed package. With aluminium or nylon trays, it is often necessary to use thermoformed lids with a snap-fit or to use a foil lid crimped to the tray because it is not easy to seal materials thereto.

The present invention provides a lid which is made from a plastic film and may be used together with a plastic or metal container for cooking in conventional convection ovens or microwave ovens.

Accordingly, the present invention provides a tray having a floor, walls attached thereto, said walls having a rim distal to the floor, said tray having food placed therein and a film formed across the rim and extending down the outer portion of the wall adjacent to the film in a vacuum-induced and thermally-set crimp, said film being selected from films of amorphous polyester, partially crystalline polyester and mixtures thereof; amorphous polyester, partially crystalline polyester and mixtures thereof admixed with a compatibilized polyolefin; and amorphous nylon and mixtures thereof with a compatibilized polyolefin.

In a preferred embodiment the tray has an externally protruding lip at the film and the film extends above and below the lip.

In another embodiment, the tray is shallow and the film extends down the outer sides of the walls and partially under the floor.

In another embodiment the polyester is polyethylene terephthalate.

Provided that the tray has sufficient rigidity to withstand forces engendered in the process for making the vacuum-induced and thermally-set crimp, the tray may be made from any suitable material. For example, for prepackaged food intended for conventional convection oven cooking, the tray may be made of aluminium, CPET, nylon, coated paper-board, amongst other materials. For microwave cooking, any of the immediately aforementioned materials are suitable except for aluminium.

An amorphous polyethylene terephthalate lid is less suited to conventional convection oven applications because it will not withstand temperatures in excess of about 177° C. It is, however, suitable for microwave oven applications. A partially crystalline polyethylene terephthalate lid may be used in conventional convection or microwave oven applications as, depending on the level of crystallinity, it may withstand temperatures up to about 232° C. While the amorphous film is clear and remains clear when heated to 177° C., the partially crystalline film has varying degrees of opacity and often becomes more opaque and crystalline after heating in the oven at, e.g. 204° C.

The film is preferably from 25 μm to 250 μm in thickness and, more preferably, from 50 μm to 175 μm.

The present invention also provides a process for making the package of the present invention comprising:

(a) placing food in a gas-impermeable tray;

(b) taking a piece of film having planar dimensions larger than said tray and sufficient to form a vacuum-induced thermally-set crimp;

(c) heating said film to a temperature of from 45° C. to 150° C. and lowering said film onto said tray while simultaneously providing a vacuum beneath said tray such that the vacuum pulls said film into intimate contact with the rim and the outer sides of the walls of the tray;

(d) cooling the film, allowing the outer edges of the film to set around said rim and walls to form a permanently set lid with a vacuum-induced thermally-set crimp; and (e) removing the tray, with film attached, from the vacuum and trimming the edges of the film; said film being selected from films of amorphous polyester, partially crystalline polyester and mixtures thereof; amorphous polyester, partially crystalline polyester and mixtures thereof admixed with a compatibilized polyolefin; amorphous nylon, and mixtures thereof with a compatibilized polyolefin.

In a preferred embodiment the film is heated, in step (c) to a temperature of from 55° C. to 95° C.

In another embodiment the polyester is polyethylene terephthalate admixed with a compatibilized polyolefin.

The process may be carried put using conventional vacuum "skin packaging" apparatus.

In other embodiments, the tray is made from aluminium, nylon or CPET.

The process of the present invention, if attempted with films made from fully crystallized polyethylene terephthalate, or oriented nylon, will not form a vacuum-induced thermally-set crimp. The process of the present invention, when attempted solely with ionomer film, does form a vacuum-induced thermally-set crimp but such films are unsuitable for use as lids even in microwave ovens because of the low melting temperature (about 90° C.) of such films.

The term "compatibilized polyolefin" refers to olefin-based polymers having polar groups attached thereto which allow the olefin-based polymer and the nylon or polyethylene terephthalate to be blended without phase separation. Such compatibilized olefin-based polymers may be in the form of so-called graft copolymers. The compatibilized olefin-based polymers may also be mixtures of compatibilized olefin-based polymers and olefin-based polymers which are incompatible with the nylon or polyethylene terephthalate. Examples of such incompatible polymers include homopolymers of ethylene or propylene, copolymers of ethylene and $C_4$ to $C_{10}$ alpha-olefins, polyisobutylene and poly(4-methylpentene-1). Examples of compatibilized olefin-based polymers include copolymers of ethylene and an unsaturated carboxylic acid or copolymers of ethylene and an unsaturated carboxylic acid ester monomer, e.g. ethylene/vinyl acetate copolymers, ethylene/methylacrylate copolymers, ethylene/ethylacrylate copolymers, ethylene/n-butylacrylate copolymers, ethylene/-methacrylate copolymers, ethylene/methacrylic acid copolymer and partially neutralized ethylene/methacrylic acid copolymers (ionomers); hydrocarbon alpha-olefins grafted with an unsaturated carboxylic acids or hydrocarbon alpha-olefins grafted with an unsaturated anhydride, e.g. ethylene/acrylate ester copolymer grafted with an unsaturated carboxylic acid or unsaturated anhydride, ethylene/$C_4$ to $C_{10}$ alpha-olefin copolymers grafted with unsaturated carboxylic acids or ethylene/$C_4$ to $C_{10}$ alpha-olefin copolymers grafted with an unsaturated anhydride, ethylene homopolymers grafted with an unsaturated carboxylic acid and ethylene homopolymers grafted with an unsaturated anhydride. The preferred unsaturated carboxylic acid and unsaturated anhydride are maleic acid and maleic anhydride. Such compatibilized polyolefin materials must, of course, be compatible with the polyesters, e.g. polyethylene terephthalates, or nylons useful in this invention.

A suitable apparatus for carrying out the process of the present invention is available from a number of commercial suppliers. One such apparatus is available from Allied Automation Inc. of Texas, U.S.A. With such apparatus, the amorphous or partially crystalline polyester, e.g. polyethylene terephthalate film or amorphous nylon film, for example, is pulled from a roll and held in a frame. The frame is larger than the plan-form of the tray which is to be lidded. The framed film is heated from above with, for example, hot wire heating elements. The film will soften and sag slightly when the film is hot enough for forming into the vacuum-induced thermally-set crimp. The frame, with film, is caused to descend onto a tray which is filled with food and which is positioned on a table having holes therein. The heating is then stopped and vacuum applied from beneath the table. The vacuum is sufficient to pull the heat-softened film downwards around the outer walls of the tray. Preferably the tray has a lip, which allows the film to be sucked closely into contact with the upper and lower surfaces of the lip. The lip permits a tight crimp to be made. It is not a hermetic seal, however, unless the lip of the tray and/or the film has been coated with an adhesive. The vacuum is then released, the frame is permitted to release the film and the thus-lidded tray is transported away from the vacuum table. The excess film may then be trimmed, and the frame grasps more film so that the next cycle of the process may take place. Some of the excess film may be left in place, to act as a pull-tab for removal of the lid. The lid may be readily removed, when either hot or cold., by peeling the formed portion of the lid away from the fixed lip on the tray.

Figure 2:
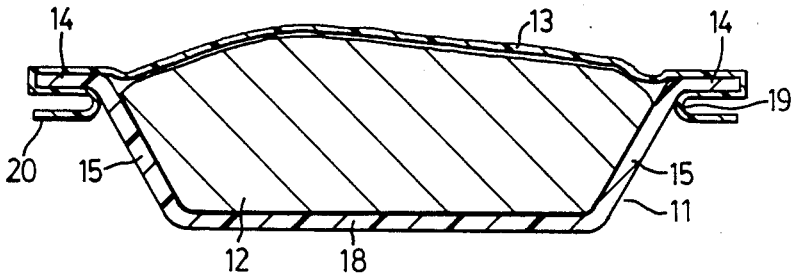

FIG. 1 shows a lidded tray, containing food, according to the present invention. FIG. 2 is a cross-section of another embodiment.

With reference to FIG. 1, a tray 11 contains food 12 and is covered by film 13. Tray 11 has a rim 14 distal to the floor, and wall 15 between the floor (not visible in the FIGURE) and rim 14. Film 13 is formed across rim 14 and is wrapped around rim 14 with a vacuum-induced and thermally-set crimp. The periphery 17 of film 13 extends down to the outer portion of wall 15. FIG. 2 shows a tray 11, with floor 18, wall 15, and rim 14, filled with food 12. Film 13 is formed across rim 14 and is wrapped around rim 14 with a vacuum-induced and thermally-set crimp 19. The periphery of film 13 extends a short way down wall 15 and ends in a tab 20.

The present invention is illustrated by reference to the following examples:

EXAMPLE I

The apparatus used in this example was an Allied Automation Inc. skin packaging machine which comprised, essentially, a vacuum table, a vertically moveable film-holding frame, an infra-red heater above the frame, means to move food-filled trays onto and off the vacuum table and means for transporting film from a supply roll to the film-holding frame. A film made from a mixture of an amorphous polyethylene terephthalate and an ionomer, 51 μm in thickness, available under the trade mark Wrapsure, was transported from a supply roll to the film-holding frame which was 35.5 cm×50.75 cm in area. The film was held 10 cm away from an infra-red heater. Concurrently with this operation, a 13.5 cm×20.5 cm×1.5 cm rectangularly shaped nylon tray having rounded corners and having a lip, 2 mm thick×6 mm wide, filled with about 350 g semi-solid food, was transported onto the vacuum table. The vacuum table was 30.5 cm×45.75 cm and comprised a perforated metal sheet with rows of holes about 1.6 mm in diameter. The rows were about 4 mm apart. The film, held within the frame, was heated by the heater for about 10 s and the frame was then caused to move vertically downwards so that the film was pulled in contact with the lip of the tray. The temperature of the heated film was about 50° C. Vacuum of about 17 kPa was applied from beneath the vacuum table during the period when the film was being lowered onto the tray. Application of the vacuum was continued for a further 10 s and the edges of the film, still in a semi-plastic state, were pulled under the lip of the tray, thus forming a vacuum-induced thermally-set crimp. The vacuum was shut off. The thus-lidded tray was removed from the vacuum table and cooled by ambient air before the excess film around the lidded tray was trimmed with a knife.

Further samples of Wrapsure film, of thicknesses up to 320 μm were similarly formed into a lid using asimilar process, but with film temperatures up to 100° C. and using vacuum of up to about 50 kPa. The trays were equally well lidded with a vacuum-induced thermally-set crimp.

EXAMPLE II

Example I was repeated except that the film was an amorphous, but crystallizable, polyester copolymer film, 51 μm in thickness sold under the trade mark Kodar A150. The initial heating of the film, to a temperature of about 75° C., required about 10–20 s. The film provided a securely crimped lid. Similar experiments were conducted using such films up to 130 μm in thickness. Packages so formed were suitable for heating food in a conventional oven, to a temperature up to about 232° C., or in a microwave oven.

EXAMPLE III

Example I was repeated except that the film was an amorphous, non-crystallizable, polyester film, 130 μm in thickness, sold under the trade mark PCTA 6763. The conditions under which the lid was formed was similar to that in Example II. Packages so formed were suitable for microwave cooking When placed in a convection oven, the lids of packages tended to melt at temperatures of about 232° C.

EXAMPLE IV

Example I was repeated except that the film was an amorphous nylon film, 76 μm in thickness, made from an amorphous nylon sold under the trade mark Zytel 330. The conditions under which the lid was formed was similar to that in Example II. Packages so formed were suitable for microwave cooking. When placed in a convection oven, the lids of packages tended to become brittle at temperatures of about 232° C.

I claim:

1. A tray having a floor, walls attached thereto, said walls having a rim distal to the floor, said tray having food placed therein and a film formed across the rim and extending down the outer portion of the wall adjacent to the rim in a vacuum-induced and thermally-set crimp, said film being selected from films of amorphous polyester, partially crystalline polyester and mixtures thereof; amorphous polyester, partially crystalline polyester and mixtures thereof admixed with a compatibilized polyolefin; and amorphous nylon and mixtures thereof with a compatibilized polyolefin.

2. A tray according to claim 1 wherein the tray has an externally protruding lip at the rim and the film extends above and below the lip.

3. A tray according to claim 2 wherein the tray is shallow and the film extends down the outer sides of the walls and partially under the floor.

4. A tray according to claim 1 wherein the polyester is polyethylene terephthalate.

5. A tray according to claim 2 wherein the polyester is polyethylene terephthalate.

6. A tray according to claim 2 wherein the film is made from a mixture of an amorphous polyethylene terephthalate and an ionomer.

7. A tray according to claim 2 wherein the film is made from an amorphous nylon.

8. A tray according to claim 2 wherein an adhesive is applied between the lip of the tray and the film.

9. A tray according to claim 5 wherein an adhesive is applied between the lip of the tray and the film.

10. A tray according to claim 6 wherein an adhesive is applied between the lip of the tray and the film.

11. A tray according to claim 7 wherein an adhesive is applied between the lip of the tray and the film.

12. A tray according to claim 2 wherein the film is from 25 μm to 250 μm in thickness.

13. A tray according to claim 5 wherein the film is from 25 μm to 250 μm in thickness.

14. A tray according to claim 6 wherein the film is from 25 μm to 250 μm in thickness.

15. A tray according to claim 7 wherein the film is from 25 μm to 250 μm in thickness.

16. A tray according to claim 2 wherein the tray is made of nylon.

17. A tray according to claim 5 wherein the tray is made of nylon.

18. A tray according to claim 6 wherein the tray is made of nylon.

19. A tray according to claim 7 wherein the tray is made of nylon.

20. A tray according to claim 2 wherein the compatibilized olefin-based polymer is selected from copolymers of ethylene and unsaturated carboxylic acid, copolymers of ethylene and unsaturated carboxylic acid ester monomers, hydrocarbon alpha-olefins grafted with unsaturated carboxylic acids, and hydrocarbon alpha-olefins grafted with unsaturated anhydrides.

21. A tray according to claim 19 wherein the compatibilized polyolefin material is selected from ethylene/vinyl acetate copolymers, ethylene/methylacrylate copolymers, ethylene/ethylacrylate copolymers, ethylene/n-butylacrylate copolymers, ethylene/methacrylate copolymers, ethylene/methacrylic acid copolymer and partially neutralized ethylene/methacrylic acid copolymers.

22. A tray according to claim 19 wherein the compatibilized polyolefin material is selected from ethylene/acrylate ester copolymer grafted with an unsaturated carboxylic acid, ethylene/acrylate ester copolymers grafted with an unsaturated anhydride, ethylene/$C_4$ to $C_{10}$ alpha-olefin copolymers grafted with unsaturated carboxylic acids, ethylene/$C_4$ to $C_{10}$ alpha-olefin copolymers grafted with an unsaturated anhydride, ethylene homopolymers grafted with unsaturated carboxylic acids, and ethylene homopolymers grafted with an unsaturated anhydride.

* * * * *